US006202564B1

(12) United States Patent
Hart et al.

(10) Patent No.: US 6,202,564 B1
(45) Date of Patent: Mar. 20, 2001

(54) DOUBLE END DERAIL

(75) Inventors: Lonnie Lee Hart, Boston, IN (US); Ronald Pease, Hickory Hills, IL (US)

(73) Assignee: Western-Cullen-Hayes Inc., Chicago, IL (US)

( * ) Notice: Subject to any disclaimer, the term of this patent is extended or adjusted under 35 U.S.C. 154(b) by 0 days.

(21) Appl. No.: 09/166,886

(22) Filed: Oct. 5, 1998

(51) Int. Cl.[7] ..... B61F 19/10

(52) U.S. Cl. ..... 104/261; 246/163; 104/262; 104/265; 104/267; 104/268; 104/269

(58) Field of Search ..... 246/163; 104/261, 104/262, 264, 265, 267, 268, 269, 32.2

(56) References Cited

U.S. PATENT DOCUMENTS 1,035,875 * 8/1912 Hancock ..... 104/265
1,301,556 * 4/1919 Gravis ..... 246/163
1,687,667 * 10/1928 Helmes ..... 246/163
2,546,667 * 3/1951 Hayes ..... 246/163
2,829,246 * 4/1958 Hayes ..... 246/163
4,165,060 * 8/1979 Meyer ..... 246/163

FOREIGN PATENT DOCUMENTS

122362 * 7/1918 (GB) .

* cited by examiner

*Primary Examiner*—S. Joseph Morano
*Assistant Examiner*—Frantz F. Jules
(74) *Attorney, Agent, or Firm*—Banner & Witcoff, Ltd.

(57) ABSTRACT

A bi-directional derail is provided with an improved construction which reduces the thrust load imparted by a rail vehicle wheel against the derail, while maintaining the weight and material cost of the derail within practical limits. In a preferred embodiment, the derail is provided with a derail shoe having deflector bars which are reinforced with deflector rail support flanges for increased strength and which have an extended length and gradual deflection angle, preferably no more than 15 degrees from the longitudinal axis of the rail.

11 Claims, 3 Drawing Sheets

DOUBLE END DERAIL

BACKGROUND OF THE INVENTION

This invention relates generally to safety devices for vehicles that travel on a rail. Specifically, the invention relates to double end or bi-directional derails for derailing and thereby stopping a runaway railed vehicle traveling in either of two directions on a rail system.

Derails are devices that are situated on or near a rail and which may be selectively positioned with respect to the rail so as to cause a runaway railcar to become derailed. Derails are useful, for example, to protect personnel or other rail vehicles from harm. As exemplified by U.S. Pat. No. 2,829,246, the subject matter of which is hereby incorporated by reference in its entirety, bi-directional slidable derails are known. These devices typically comprise a derail shoe having derailing bars, and a guide box to allow the derail to be moved into and out of the derailing position.

Such prior art derail configurations are typically damaged after use, necessitating replacement or considerable repair of the derail. Usually, significant deformation and damage to the derail shoe occurs as a result of the impact of the rail vehicle wheel with the derail shoe. This is due to the high thrust load of the railed vehicle wheel against the derail shoe during impact. As a result of the high thrust load in prior art derails and the massive construction required to withstand the large impact forces of very heavy railed vehicles, prior art derails are characterized by significant weight and material cost. On the other hand, excessive weight is undesirable since a great deal of manual or automated effort is required to install and actuate derails in general. Thus, derail construction efforts have focused on providing for sufficient diversion or absorption of the thrust load while maintaining reasonable or practical weight of the derail assembly.

U.S. Pat. No. 2,829,246, describes the use of slight deflection angles on single directional derails. However, such modifications to single directional derails have heretofore been recognized as disadvantageous when applied to bi-directional derails because the resulting configuration is often too heavy. In fact, the prior art exemplified by U.S. Pat. No. 2,829,246 discloses only compact bi-directional configurations which have rather abrupt deflection angles and Thus, prior art bi-directional derails suffer from the disadvantage of sacrificing more gradual deflection angles in favor of providing a compact design. It would therefore be desirable to provide a bi-directional derail construction which reduces the thrust load of the railed vehicle during impact by providing gradual deflection angles while maintaining the overall derail weight and material cost within practical limits.

SUMMARY OF THE INVENTION

The present invention solves the aforementioned problems and others by providing a bidirectional derail construction which permits a gradual deflection angle. In a preferred embodiment, the invention provides a derail having a welded plate construction with a derail shoe assembly including a deflector rail with extended engagement surfaces and gradual engagement angles relative to the longitudinal extent of the rail. Specifically, the invention provides a derail having a derail shoe length of at least 43 inches and first and second deflector bars to have angles of less than 15 degrees relative to the rail. In accordance with the invention, increased strength is achieved through the use of deflector rail support flanges which abut the deflector rail and extend along an angled plate on the derail shoe assembly. In accordance with another aspect of the invention, lateral support blocks are provided on the derail guide assembly to engage or abut the web of the rail and to thereby strengthen the torsional resistance of the derail guide assembly.

BRIEF DESCRIPTION OF THE DRAWINGS

The accompanying drawings which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings, in which like numbers refer to like parts throughout.

DESCRIPTION OF THE PREFERRED EMBODIMENTS

Figure 1:
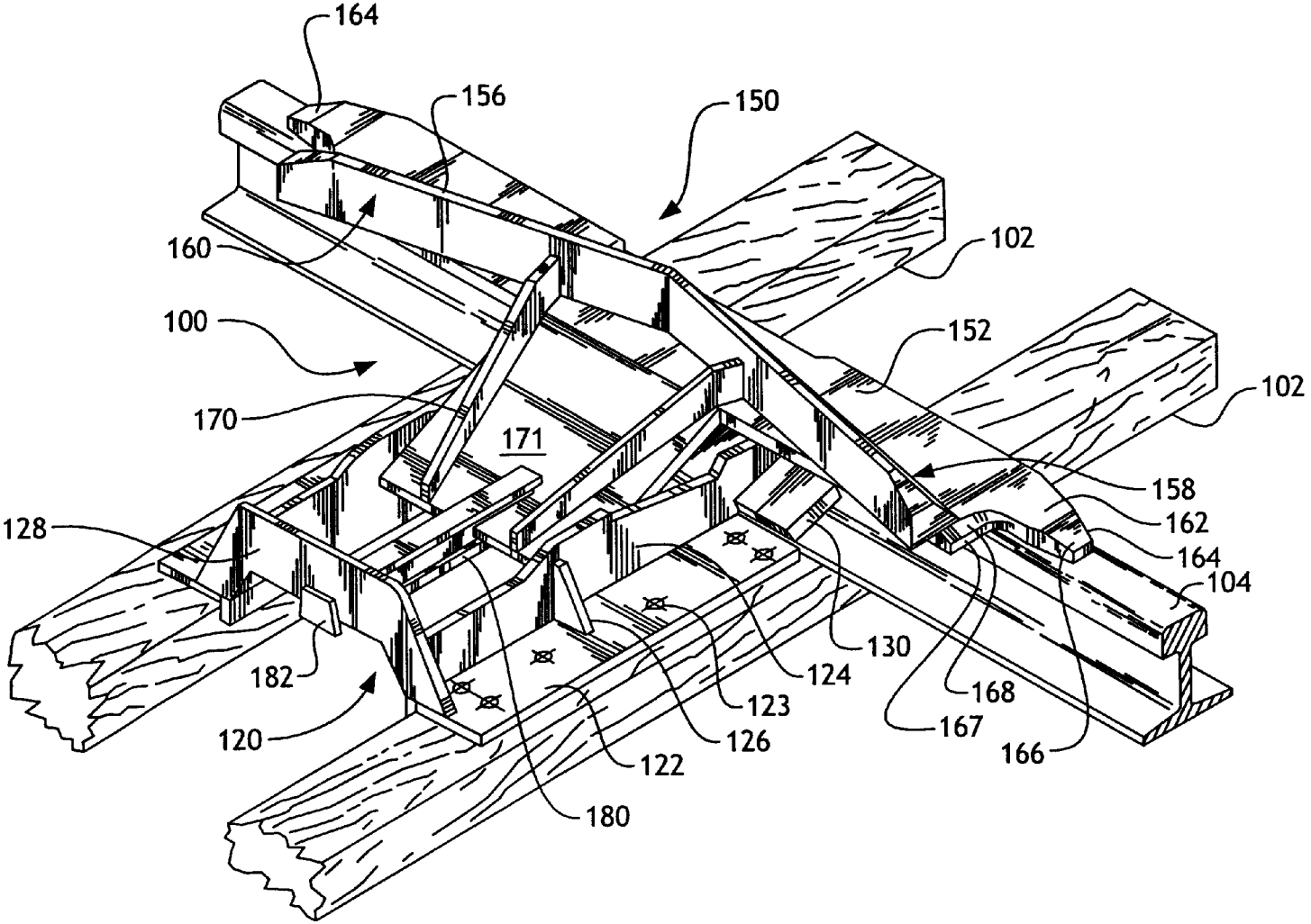
FIG. 1 is a perspective of a derail according to a preferred embodiment of the present invention.

Referring to FIG. 1, is a perspective view of a slidable, bi-directional derail 100 according to a preferred embodiment of the present invention. Derail 100 is typically situated between two railroad ties 102 which support two rails 104 (only two ties and one rail are illustrated). Derail 100 is comprised of two general components, derail guide assembly 120 and derail shoe assembly 150. Derail guide assembly guides derail shoe assembly 150 for selective movement between a retracted position and a wheel-engaging position as will be explained in detail below.

Guide assembly 120 is preferably of a welded ¾-inch steel plate construction having a general box-like shape, including a pair of mounting flanges 122, each provided with mounting holes 123 to receive fasteners (not shown), typically railroad spikes, for securing guide assembly 120 to ties 102. Each mounting flange 122 is fastened, preferably by welding, to a respective sidewall 124 which extends generally perpendicular thereto. One or more reinforcing braces 126 are provided to further strengthen the guide assembly 120. A cross member 128 is provided to connect sidewalls 124 at a rear end of derail guide assembly 120.

In accordance with one aspect of the invention, a guide block 130 is provided fastened to and extending generally perpendicular to each sidewall 124 and parallel with the longitudinal extent of rail 104. Guide block 130 functions to engage or abut the web of rail 104 and is preferably comprised of a steel block welded to each sidewall 124. As will be appreciated by those of ordinary skill, one advantage provided by guide blocks 130 is to increase the ability of the guide rail assembly 120 to withstand torsional forces, i.e., forces that would tend to twist the guide rail assembly about a vertical axis, when the wheel of a railed vehicle impacts the derail 100. This results in increased strength in the derail guide assembly 120 and ultimately permits a more gradual deflection angle on the derail shoe assembly 150 as will be explained below.

Derail shoe assembly 150 includes a derail shoe 152, which is generally comprised of a deflecting bar 156 and a base portion 162. Deflecting bar 156 is preferably of a generally triangular cross-section and includes a deflecting surface 158 and rear surface 160. Base portion 162 includes an extension 164 at each end thereof. When the derail shoe assembly is deployed in a wheel-engaging position, base portion 162 rests on an upper surface of rail 104 and extensions 164 are coextensive with rail 104. A first bevel 166 is provided on each extension 164. Base portion 162 also includes a curved recess 167 at each end thereof which is provided with a second bevel 168. Both first and second bevels provide for reduced impact an reduce the potential for wear and deformation when the wheel of a rail vehicle impacts the derail shoe 152.

Base portion 162 is welded to an angled plate 171 extending rearward from deflecting bar 156 and which is of a width permitting it to be disposed between sidewalls 124 and which extends away from deflecting bar 156 at a downward angle. Attached to angled plate 171 is an actuating arm 180 which extends rearward and which is provided with a stop lug 182 for engaging cross member 128 to restrict forward movement of derail shoe assembly 150.

In accordance with another aspect of the invention, a pair of deflection rail support flanges are provided attached to angled plate 171 and abutting rear surface 160 of deflecting bar 156. Deflection rail support flanges 170 provide increased lateral support to deflecting bar 156 to resist lateral forces caused by the impact of a railed vehicle wheel on deflecting bar 156. The presence of deflection rail support flanges 170 therefore provides for a strong construction of the derail assembly 150 thereby reducing material costs while permitting an increased length and a resulting gradual deflecting angle of the bi-directional derail while maintaining a practical overall weight.

Figure 2:
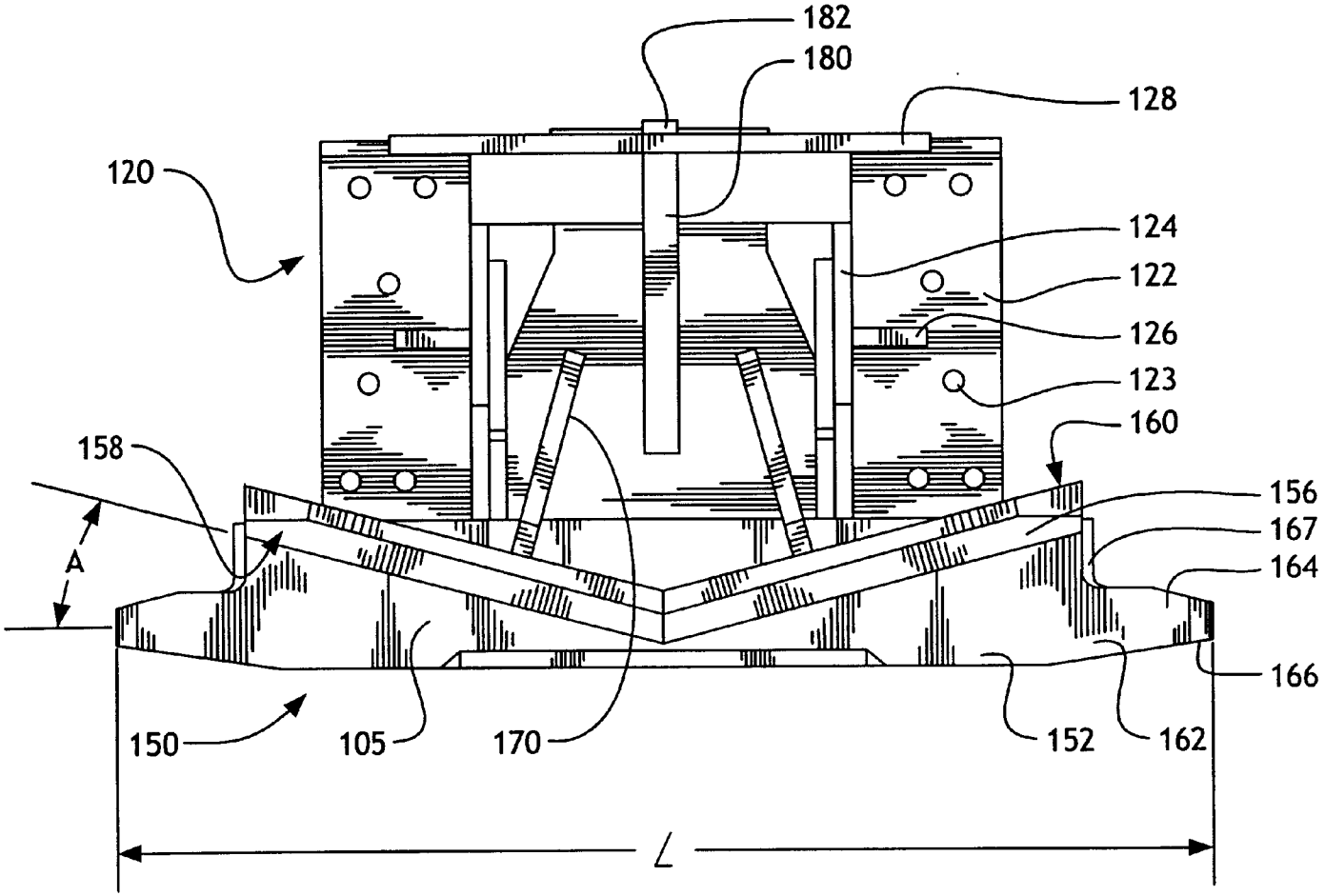
FIG. 2 is a top view of derail shown in FIG. 1.

Referring additionally to FIG. 2, in accordance with another aspect of the invention, a bidirectional derail is provided having a gradual deflection angle (A) of not more than 15 degrees, made possible by the derail construction of the present invention. Particularly, a deflection angle of less than 15 degrees, as measured from the longitudinal axis 105 of rail 104, is provided for deflection surface 158. In addition, the length (L) of derail shoe 152, is preferably over 43 and ½ inches. Particularly, the increased reinforcement and strength provided by the welded plate construction, including deflection rail support flanges 170 and guide blocks 130, permit the bi-directional derail to be of an extended length compared to prior art devices and thereby permit a more gradual deflection angle while maintaining derail weight within practical limits.

The reduced deflection angle of deflection surface 158 provide for a reduction in the impact energy imparted to the derail when a railed vehicle wheel encounters deflection surface 158. As a result, derail 100 can be manufactured at a reduced cost relative to prior art derails and will generally have a longer useful life and be more effective at derailing heavier or faster moving rail vehicles compared to prior art derails.

Figure 3A:
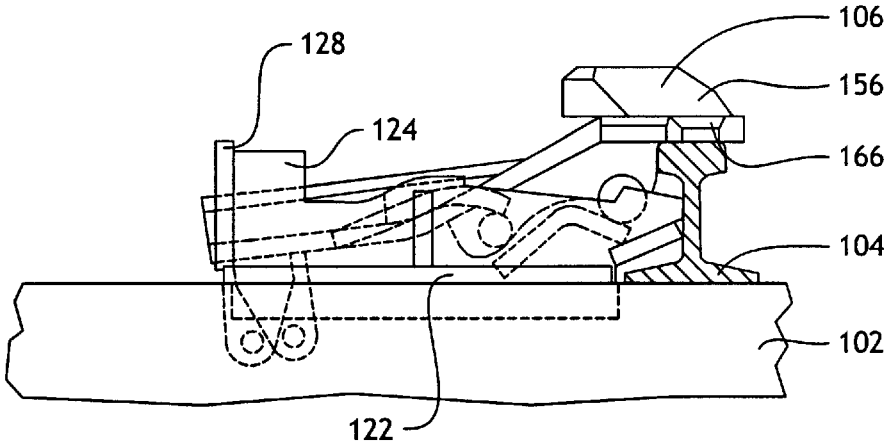
FIG. 3A is a side view of the derail shown in FIG. 1 with the derail shoe in a wheel-engaging position.
Figure 3B:
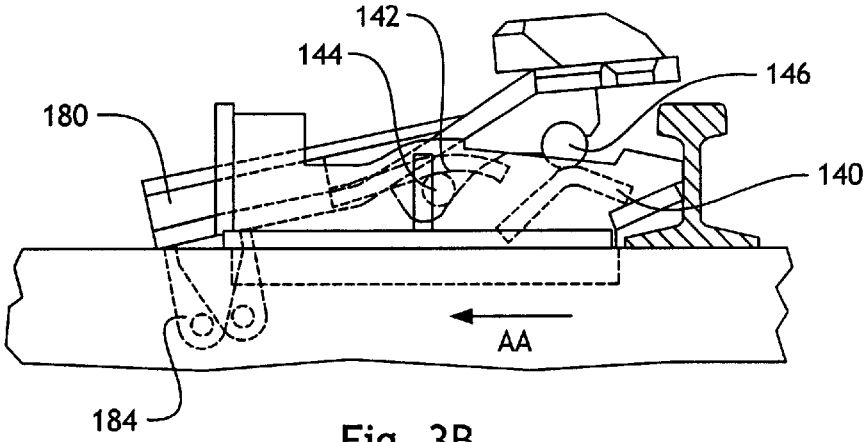
FIG. 3B is a side view of the derail shown in FIG. 1, with the derail shoe in an intermediate position.
Figure 3C:
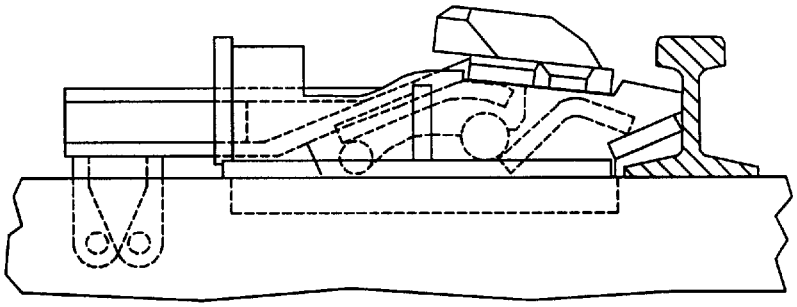
FIG. 3C is a side view of the preferred embodiment with the derail shoe in a retracted position.

Referring now to FIGS. 3A–3C, further features of the construction and operation of a bidirectional derail according to a preferred embodiment of the present invention can be seen FIG. 3A is a side view of the preferred embodiment of this invention in the derailing position with derail shoe 106 resting on top of rail 104, which is shown in cross-section. Although not illustrated in FIGS. 1 and 2, derail guide assembly 120 is provided with front and rear guides 140 and 142 for guiding hold-down pin 144 and thrust shaft 146 as derail shoe assembly moves from its retracted position to its wheel-engaging position. Rear guiding members 142 (one illustrated in FIGS. 3A–3C) are provided as a curved shelf extending perpendicularly from sidewall 124 inwards toward derail shoe assembly 150. Hold down pin 144 extends from derail shoe assembly and engages the underside of rear guiding members 142. A front guide 140 is provided forward of rear guide 140 on sidewall 124 for engaging the circumferential surface of cylindrical thrust shaft 146. As can be seen from FIGS. 3A–3C, front and rear guides 140 and 142 provide for appropriate movement of derail shoe assembly as it moves from its wheel engaging position, shown in FIG. 3A, to an intermediate position shown in FIG. 3B, to a retracted position, shown in FIG. 3C.

As is also evident from FIGS. 3A–3C, a series of lugs 184 fastened to actuator arm 180 provide for the fastening of automatic or manual implements (not shown) for actuating the derail. As a force in the direction depicted by arrow AA is applied to lugs 184, thrust shaft 146 follows the contour of the top of front locking seat 140 and hold down pin 144 follows the contour of the bottom of hold down shelf 142, which causes derail shoe 106 to move up and away to the left from rail 104, as depicted in FIG. 3B. As such a force continues to be applied to lugs 184, derail shoe 106 ultimately comes to rest in the non-derailing position, as depicted in FIG. 3C.

Those skilled in the art will recognize that the preferred embodiments may be altered or amended without departing from the true spirit and scope of the invention, as defined in the accompanying claims.

What is claimed is:

1. A bi-directional derail for engaging and thereby derailing a wheel of a railed vehicle, the derail comprising:

a derail shoe assembly for engaging the wheel of the railed vehicle, which derail shoe assembly includes a deflecting bar having a deflection surface which extends at an angle to a rail of not more than 15 degrees, and a derail guide assembly, for guiding the derail shoe assembly for selective movement between a wheel engaging position, in which the derail shoe assembly is positioned to engage the wheel of the railed vehicle traveling on the rail, and a retracted position, in which the derail shoe assembly is situated beside the rail.

2. The bidirectional derail of claim 1, further comprising at least one guide block provided on the derail guide assembly for increasing the resistance to torsional movement of the derail guide assembly.

3. The bidirectional derail of claim 1, wherein the derail guide assembly further comprises a pair of sidewalls for restricting longitudinal movement of the derail shoe assembly, the sidewalls each being provided with a guide block extending in a longitudinal direction for increasing the resistance to torsional movement of the derail guide assembly.

4. The bi-directional derail of claim 1, further comprising at least one deflection rail support flange abutting the deflecting bar for increasing strength against lateral loading thereof.

5. The bidirectional derail of claim 1, further comprising at least one deflection rail support flange abutting the deflecting bar for increasing strength against lateral loading thereof, the deflection rail extending in a direction substantially perpendicular to a deflecting surface of the deflecting bar.

6. The bi-directional derail of claim 1, wherein the derail shoe assembly further comprises a base for supporting the deflecting bar.

7. The bi-directional derail of claim 6, further comprising an angled plate extending at an angle to the base.

8. The bi-directional derail of claim 7, further comprising at least one deflection rail support flange abutting the deflecting bar and secured to the angled plate.

9. A bi-directional derail for derailing a railed vehicle from a rail comprising:

a derail shoe assembly having a derail shoe including a deflecting rail for engaging a wheel of the railed vehicle, the deflecting rail including two deflecting surfaces extending at an angle of not more than 15 degrees from the longitudinal extent of a rail;

a derail guide assembly, for guiding the derail shoe assembly for selective movement between a wheel-engaging position, in which the derail shoe assembly is positioned to engage the wheel of the railed vehicle traveling on the rail, and a retracted position, in which the derail shoe assembly is situated beside the rail;

the derail shoe assembly including a deflecting bar having a deflection surface which extends at an angle to the rail of not more than 15 degrees, at least one guide block provided on the derail guide assembly for increasing the resistance to torsional forces on the derail guide assembly, and at least one deflection rail support flange abutting the deflecting bar for increasing strength against lateral loading thereof.

10. In a bi-directional derail for derailing a wheel of a rail vehicle from either of two directions and being selectively movable from a retracted position to a wheel-engaging position, the improvement comprising:

an elongated derail shoe having a first deflector bar for derailing a rail car traveling in a first direction on a rail and a second deflector bar for derailing a rail car traveling in a direction opposite to said first direction, said first and second deflector bars being positioned at not more than a 15 degree angle relative to the longitudinal axis of said rail.

11. The apparatus of claim 10, wherein said elongated derail shoe is at least 43-and-½ inches long.

* * * * *